US005857473A

United States Patent [19]

Vanover et al.

[11] Patent Number: 5,857,473

[45] Date of Patent: Jan. 12, 1999

[54] DISHWASHER RACK RETAINER

[76] Inventors: Kim Vanover; Larry Vanover, both of 10000 Hwy. 98N, #638, Lakeland, Fla. 33809

[21] Appl. No.: 927,241

[22] Filed: Sep. 11, 1997

[51] Int. Cl.[6] ..... B08B 3/02

[52] U.S. Cl. ..... 134/135; 134/201; 211/41.2

[58] Field of Search ..... 134/56 D, 57 D, 134/58 D, 201, 135, 176, 179; 211/41.2, 41.8, 41.9

[56] References Cited

U.S. PATENT DOCUMENTS

| | | |
|---|---|---|
| 4,974,806 | 12/1990 | Matern . |
| 5,114,019 | 5/1992 | Sandbank . |
| 5,131,620 | 7/1992 | Boundy . |
| 5,201,826 | 4/1993 | Zimmerman . |
| 5,497,890 | 3/1996 | Clark . |
| 5,518,126 | 5/1996 | Davis . |

*Primary Examiner*—Frankie L. Stinson
*Attorney, Agent, or Firm*—Kenneth L Tolar

[57] ABSTRACT

The present invention relates to a new and improved retaining device designed to hold articles in a top or bottom dishwasher rack preventing them from dislodging during a wash cycle. The device comprises a substantially rectangular net member attached to a window shade type roller assembly. The roller assembly may be removably attached to any side of a top or bottom dishwasher rack. The net member has a substantially centrally located aperture for receiving a dishwasher water tower allowing the device to be easily used to retain items placed in a lower dishwasher rack. The net member also has one or more mesh storage pockets on a side thereof allowing additional lightweight articles to be stored therein. Longitudinal stainless steel reinforcement strips are provided on the net member allowing it to be easily retracted within the roller assembly and allowing it to more tightly engage articles stored in the dishwasher rack.

8 Claims, 2 Drawing Sheets

DISHWASHER RACK RETAINER

BACKGROUND OF THE INVENTION

Lightweight articles such as plastic lids, spoons, bowls, baby bottles and similar devices are often placed in either the upper or lower dishwasher rack. Often these articles will become dislodged from the dishwasher rack due to high pressure streams of water being upwardly projected thereagainst. When these articles become displaced during the wash cycle, they often become filled with water preventing them from being rinsed properly usually requiring them to be washed again. Sometimes the dishes fall near the heating element on the bottom of the dishwasher and are melted. The present invention overcomes these problems by providing a retaining device that can be used on either the top or bottom dishwasher rack and which also has a plurality of storage pockets thereon for securing items such as lids and silverware thereby increasing the capacity of the dishwasher.

DESCRIPTION OF THE PRIOR ART

Many dishwasher retaining racks or nets currently exist in the prior art. These devices typically comprise a rectangular mesh type net or plastic coated, wire frame panels that extend over the dishwasher rack to retain dishes therein. The openings in the net or wire frame panels are typically only large enough to allow water to pass therethrough so that smaller lightweight items such as silverware or lids will be retained within the rack. Most dishwashers have a water spray tower on their bottom interior comprising a conical device which typically protrudes through the lower rack when the rack is loaded and pushed back into the dishwasher. The prior art wire panels and nets designed to cover the entire rack cannot be used on a lower dishwasher rack since the water tower would prevent the cover from resting tightly against dishes stored therein. Furthermore, a cover resting on top of the water tower would interfere with the water projected therefrom preventing the dishes on the upper rack from being cleaned and rinsed properly.

The prior art window shade type retractable retaining nets are typically made from a lightweight, mesh nylon type material. The minimal weight of the net makes it difficult to retract within the roller assembly. The lightweight, mesh type material often becomes frayed or worn in a short period of time. The prior art nets usually stretch over a period of time and do not provide a tight cover allowing smaller, lightweight dishes to escape.

It is sometimes necessary to store smaller items such as plastic lids in the dishwasher rack. Often the prior art retaining nets will not adequately retain these items since they may easily slip through the bottom of the rack itself regardless whether a retaining net is used. U.S. Pat. No. 5,518,126 issued to Davis discloses a net for a dishwasher rack attached to a roller assembly which may be removably attached to the dishwasher rack. The net may then be selectively extended or retracted like a window shade. The device cannot be used with a lower dishwasher rack for the reasons described above and has no dish storage pockets or compartments thereon.

U.S. Pat. No. 5,479,890 issued to Clark relates to a plastic container for holding lightweight articles in a dishwasher rack. The device comprises a plurality of rigid panel members which may be collapsed in an accordion type fashion. The device is designed for use with the upper rack of a dishwasher.

U.S. Pat. No. 5,201,826 issued to Zimmerman discloses a substantially rectangular dishwasher retaining net having an expansible and contractible border which resembles a bed sheet. The device may then be fitted about the periphery of an upper dishwasher rack.

U.S. Pat. No. 5,131,620 issued to Boundy relates to a rack for suspending an electrical mechanical component below a support surface.

U.S. Pat. No. 5,114,019 issued to Sandbank discloses a net having a circular portion made of an elastic mesh to provide tension along the periphery of the net when the net is secured about a dishwasher rack.

U.S. Pat. No. 4,974,806 issued to Matem relates to a dishwasher accessory comprising elongated flexible cords for contacting dishes and utensils thereby holding them in place in a dishwasher rack. As indicated above, the aforementioned prior art retaining nets are not adapted to be used with the lower dishwasher rack, particularly in dishwashers having an upwardly projecting water tower or similar water delivery device. None of the aforementioned retainers have additional storage compartments thereon for receiving lids and other easily displaced items. Therefore, there is currently a need for a retaining device that may be used with either the upper or lower rack and is capable of storing and securing small, lightweight articles such as plastic lids. By securing and storing lightweight lids and similar articles within the retaining device, the items are prevented from being forced through the dishwasher rack. Also, by storing these items within storage pockets on the retaining net, additional space within the rack is available for storing heavier items thereby increasing the overall storage capacity of the dishwasher.

SUMMARY OF THE INVENTION

The present invention relates to a new and improved dishwasher rack retaining device designed to be easily and removably attached to either the top or bottom dishwasher rack. The device comprises a substantially rectangular net member, an edge of which is attached to a window shade style roller mechanism allowing the net to be selectively extended or retracted. The roller mechanism housing may be quickly and easily attached to any side of either the top or bottom dishwasher rack using clips or any other suitable attachment means. In addition, the net member has one or more mesh pockets attached to a side thereof allowing additional lightweight items such as plastic silverware or lids to be stored therein. Attachment means are provided on the open edge of the mesh pockets allowing the plastic items to be secured therein.

The net member also comprises a plurality of longitudinal stainless steel straps on a side thereof disposed substantially perpendicular to the roller mechanism. The stainless steel straps reduce wear and tear on the net member and provide additional rigidity therefor so that the net will more tightly engage the dishes retained underneath. The stainless steel straps also significantly increase the weight of the net member allowing it to be more easily extended from or retracted within the roller assembly.

The net member has a centrally located aperture dimensioned to receive a dishwasher water spray tower. The centrally located aperture allows the roller assembly to be mounted to the bottom rack whereby the net member may be extended with the water tower protruding through the aperture allowing the net to tightly engage dishes resting within the rack.

It is therefore an object of the present invention to provide a dishwasher rack retaining device capable of securing and storing small lightweight items thereon.

It is yet another object of the present invention to provide a dishwasher rack retaining device adapted to interchangeably cover an upper or lower dishwasher rack and is adapted to receive a dishwasher water tower.

It is yet another object of the present invention to provide a dishwasher rack retaining device selectively retractable or extendable from a roller assembly. It is yet another object of the present invention to provide a dishwasher rack retaining device having a net, mesh like cover that is weighted allowing the net to be more easily retracted within the roller assembly. Other objects, features and advantages of the present invention will be readily apparent from the detailed description of the preferred embodiment when considered with the attached drawings and the appended claims.

DESCRIPTION TO THE PREFERRED EMBODIMENT

Figure 1:
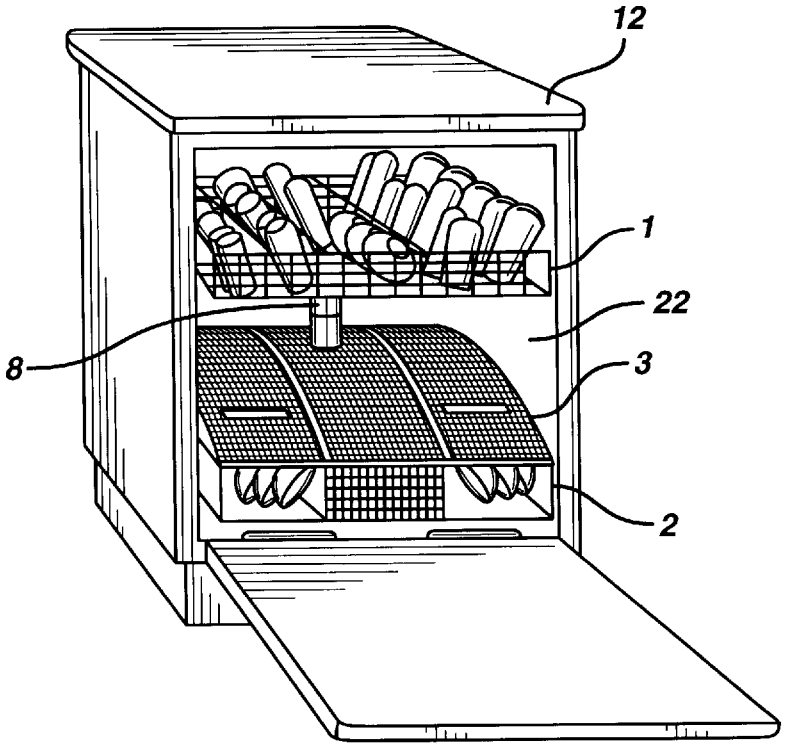
FIG. 1 depicts a standard dishwasher with a retainer according to the present invention attached to and extended over a lower rack.
Figure 2:
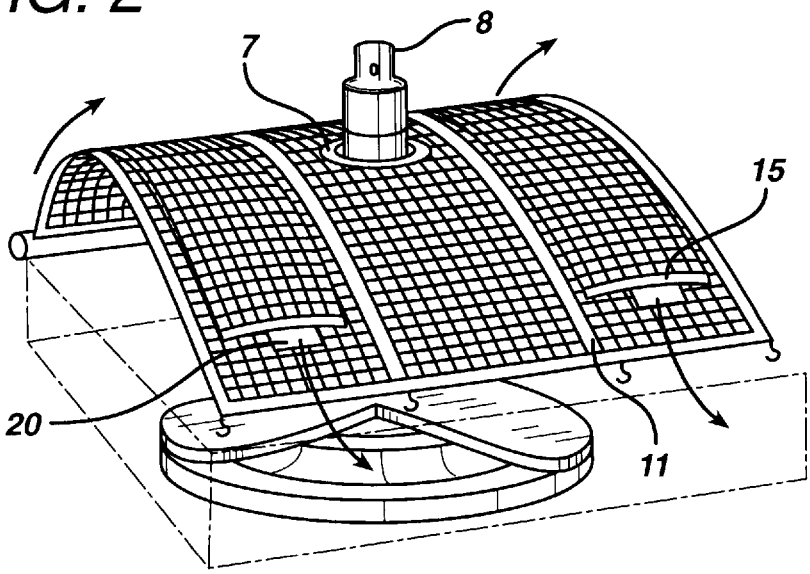
FIG. 2 depicts the net member fully extended and attached to a lower dishwasher rack with a dishwasher water tower protruding therethrough.
Figure 3:
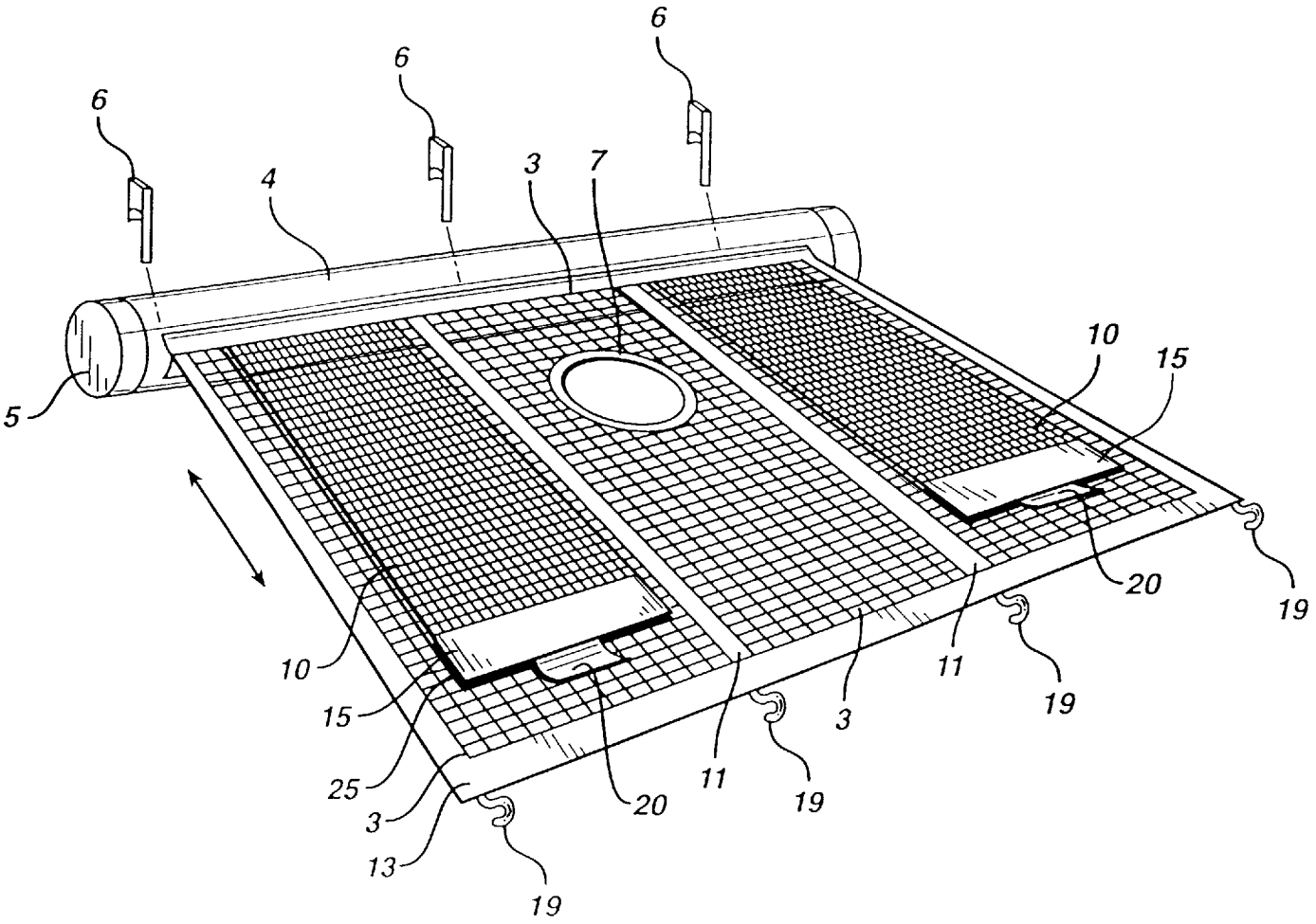
FIG. 3 depicts the window shade type roller mechanism and net extended therefrom.

Referring now to FIGS. 1 through 3, the present invention relates to a retaining device for use with a standard dishwasher 12. The dishwasher 12, as depicted in FIG. 1 generally comprises an interior chamber 22 for cleaning dishes therein. Supported within the cleaning chamber are an upper 1 and lower dishwasher rack 2. The dishwasher also has a conical water tower 8 depending upwardly from the bottom wall of the interior chamber for directing high pressure water to the upper 1 and lower racks 2.

The retaining device according to the present invention comprises a substantially planar, rectangular net member 3 constructed with a mesh like material having apertures large enough to allow water to pass therethrough while retaining small dishes and utensils underneath. The net member 3 must also have flexibility allowing it to be rolled and unrolled as desired and so that it may be extendable over various sized articles within the rack. The net member 3 generally has two sides and four peripheral edges. An edge of the net member 3 is attached to a roller assembly 4. The roller assembly comprises an elongated cylindrical housing 5 with a roller and spring mechanism therein (not pictured). The roller and spring mechanism may be any type generally known in the prior art such as those used in window shades. An edge of the net member 3 is attached to the roller within the housing allowing the net member to be retracted or extended therefrom as desired. An attachment means 6 such as hooks or clips are provided on the exterior of the roller mechanism housing 5 allowing it to be removably attached to any side of the upper 1 or lower 2 dishwasher rack.

The net member also has a substantially centrally located aperture 7 dimensioned to receive a dishwasher water tower 8 as depicted in FIG. 1. The aperture 7 allows the net member 3 and roller assembly 4 to be easily attached to a lower dishwasher rack. When the net member is extended to cover the lower dishwasher rack, the water tower 8 can protrude through the aperture 7 allowing the net member 3 to tightly engage the dishes while not interfering with water flow. As will be readily apparent to those skilled in the art, the aperture may be omitted or covered so that the net member may be more effective when used on the upper rack 1.

On a side of the net member 3 are one or more mesh storage pockets 10 preferably having four edges, three of which are attached to the net member 3. A fourth edge is removably attached to the net member 3 using a Velcro > strip 15 or any other suitable closure means such as zippers or snaps. The closure means 15 selectively engages a mating closure means 25 on a side of the net member 3. The Velcro ® strip on the storage pocket also has a flat tab 20 extending from an edge thereof so that a user can easily grasp the tab and pull to detach the mating attachment means to open the pocket 10. Preferably, the storage pockets 10 are made from a nylon mesh or similar material that would be permeable and water resistant. The storage pockets 10 are adapted to receive lightweight lids, silverware, caps and similar items that may otherwise fall through a dishwasher rack and also increase the overall storage capacity of the dishwasher. The number, shape and size of each of the storage pockets 10 may be varied to suit a particular application.

Attached to a side of the net member 3 are a plurality of flat elongated straps 11 preferably disposed substantially perpendicular to the roller mechanism housing 5 as depicted in FIG. 2. The straps 11 are designed to provide weight and rigidity to the net member 3 allowing it to be more easily extended or retracted from the roller assembly. The additional rigidity also ensures that the net member tightly engages the lightweight articles stored in the dishwasher rack. Preferably, the straps 11 are made from stainless steel or a similar material that is water resistant and has sufficient weight to achieve the above described results.

The peripheral edges of the net member 3 are formed with a border strip 13 that also adds rigidity to the net member. The border strip 13 may be constructed of vinyl or any other similar material and prevents the net member from tearing or unraveling. Attached to the border strip 13, preferably proximal an edge of the net member 3 opposite the roller assembly 4, are a plurality of hooks 19 or similar connectors allowing the fully extended net to be easily attached to a side of a dishwasher rack opposite the roller assembly.

To use the inventive device described above, the roller assembly housing 5 is attached to a side of either the upper 1 or lower 2 dishwasher rack by attaching the clips to a side of the rack. The net member is extended from within the roller assembly housing to cover the rack. An edge of the net member 3 opposite the roller assembly housing 5 is attached to a side of the rack using the connectors 19. If the retainer is being used on a lower rack 2, the water tower 8 is inserted through the aperture when the net is extended. If desired, small substantially flat, lightweight items are inserted into the storage compartments 10 and secured therein using the mating attachment means. After completion of the wash cycle, the roller assembly 4 and net 3 may remain attached to the rack or it may be removed for storage.

The various components of the present invention may be fabricated using any number of suitable materials. As a non-exclusive example only, the roller assembly housing may be fabricated from PVC or plastic. The connectors 19 are preferably constructed with plastic or a similar lightweight, water resistant material.

From the above description, it is now apparent that the present invention provides a dishwasher rack retaining device which may be interchangeably used with either the top or bottom dishwasher rack and which also increases the capacity of the dishwasher. Although there has been shown and described the preferred embodiment of the present invention, it is understood by those skilled in the art that the invention is not limited by the details of construction and arrangement of parts described above and the invention is to be interpreted and limited only in conjunction with the appended claims.

What is claimed is:

1. A retainer for holding lightweight articles in a dish rack comprising a roller assembly removably attachable to a dishwasher rack; a generally rectangular planar net member having four peripheral edges and two sides, an edge of which is attached to said roller assembly whereby said net member is selectively retractable within said roller assembly and extendable therefrom; at least one mesh storage pocket attached to a side of said net member, said storage pocket having an edge removably attachable to said net member for receiving utensils.

2. A device according to claim 1 wherein said net member further comprises a substantially centrally located aperture dimensioned to receive a dishwasher tower.

3. A device according to claim 1 further comprising a plurality of flat elongated rigid strips attached to a side of said net member for providing weight and rigidity thereto.

4. A device according to claim 1 wherein said net member further comprises a border strip along its four peripheral edges to provide rigidity thereto.

5. A device according to claim 4 comprising a plurality of connectors attached to said border strip for removably attaching an edge of said net member to a dishwasher rack.

6. A device according to claim 1 wherein said storage pocket comprises an attachment means on a side of said storage pocket proximal its removably attachable edge; a mating attachment means on a side of said net member for selectively engaging said attachment means on said storage pocket.

7. A device according to claim 6 wherein each of said attachment means is a hook and loop fastener.

8. A device according to claim 6 wherein said storage pocket further comprises a pull tab adjacent an edge thereof which may be grasped by a user to selectively detach said mutually engaging attachment means.

* * * * *